United States Patent [19]

Verduin

[11] 4,223,210

[45] Sep. 16, 1980

[54] ELECTRONIC VENDING MACHINE SELECTION COUNTER

[75] Inventor: Lee C. Verduin, Grand Rapids, Mich.

[73] Assignee: Rowe International, Inc., Whippany, N.J.

[21] Appl. No.: 882,358

[22] Filed: Mar. 1, 1978

[51] Int. Cl.[2] ..... G06M 3/06

[52] U.S. Cl. ..... 235/92 AC; 235/92 ST; 235/92 CA; 235/92 FP

[58] Field of Search ..... 235/92 AC, 92 PD, 92 ST, 235/92 CA, 92 EA, 92 PL, 92 PE, 92 FP; 340/146.2; 221/7

[56] References Cited

U.S. PATENT DOCUMENTS

| | | | |
|---|---|---|---|
| 3,268,710 | 8/1966 | Canover et al. | 235/92 ST |
| 3,426,296 | 2/1969 | Christiansen et al. | 235/92 PL |
| 3,784,979 | 1/1974 | Friedman et al. | 340/146.2 |
| 3,829,664 | 8/1974 | Kashio | 235/92 CA |
| 3,922,670 | 11/1975 | Shaw et al. | 235/92 PL |
| 3,924,078 | 12/1975 | Bussey | 235/92 CA |
| 3,967,095 | 6/1976 | Herring et al. | 235/92 ST |
| 4,075,463 | 2/1978 | Yurramendi Equizabal | 235/92 AC |

*Primary Examiner*—Joseph M. Thesz
*Attorney, Agent, or Firm*—Shenier & O'Connor

[57] ABSTRACT

Electronic apparatus for recording the number of times each selection offered by a vending machine is chosen by customers and for displaying such information sequentially in either ascending or descending order.

21 Claims, 1 Drawing Figure

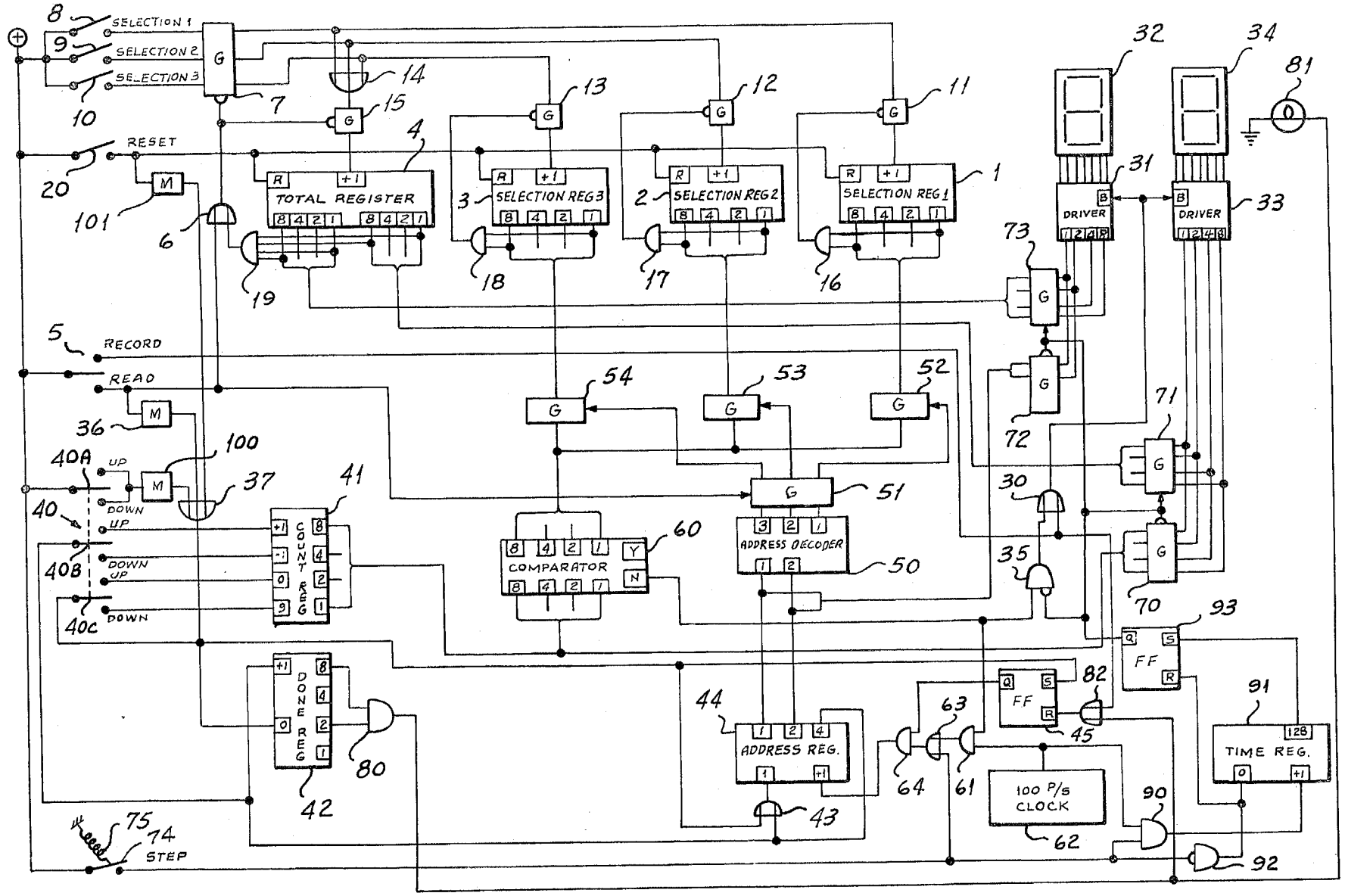
SELECTION REG 1
SELECTION REG 2
SELECTION REG 3
TOTAL REGISTER
DRIVER
DRIVER
ADDRESS DECODER
COMPARATOR
ADDRESS REG.
COUNT REG
DONE REG
TIME REG.
FF
FF
100 P/S CLOCK
SELECTION 1
SELECTION 2
SELECTION 3
RESET
RECORD
READ
UP
DOWN
UP
DOWN
UP
DOWN
STEP

ELECTRONIC VENDING MACHINE SELECTION COUNTER

BACKGROUND OF THE INVENTION

My invention relates to vending machines, and more particularly to apparatus for recording the frequency with which various selections offered have been chosen by customers.

Apparatus for recording the relative frequency with which selections offered by vending machines have been chosen are known to the prior art. Such devices are particularly useful in vending machines as jukeboxes, in which there is no decrease in physical inventory associated with choices of particular selections to indicate the frequency with which such choices have been made. These devices are all mechanical, requiring considerable maintenance and occupying a large space. One such device comprises a plurality of pins each mounted for travel along a specified path, and means for selectively tapping each pin so as to move it a little further along its path of travel. This device is complex, since it includes 100 pins and the mechanism necessary to tap each one. It requires considerable maintenance and adjustment. Furthermore, the device is inaccurate, since the tap received by a pin does not always cause the pin to travel the same amount. The readout of the number of choices made of a given selection is analog in nature rather than digital.

Further prior art is Hughes U.S. Pat. No. 3,990,710 which teaches the making of a tape record of each selection chosen in a Coin Operated Recording Machine. Hughes, however, shows no apparatus for totaling the number of choices made of a given selection, or for sorting the selections so as to reveal those which are chosen most or least frequently.

SUMMARY OF THE INVENTION

One object of my invention is to provide apparatus for counting the number of choices made of the various selections offered by a vending machine.

Another object of my invention is to provide an electronic vending machine selection counter.

Still another object of my invention is to provide a vending machine selection counter having digital accuracy.

A further object of my invention is to provide a vending machine selection counter which displays the selections in either increasing or decreasing order of their counts.

Other and further objects of my invention will appear from the following description.

In general my invention contemplates apparatus for recording the number of times each selection offered by a vending machine has been chosen by customers, and for displaying the number of choices made of each selection in either ascending or descending order of frequency.

My apparatus contains a plurality of selection registers, one associated with each of the selections offered by the machine, and each of which is capable of keeping a count of the number of times its associated selection has been chosen. The machine also contains a total register which keeps a count of the total number of selections chosen. When a selection is made, a selector device generates an electronic signal which indicates which of the selections have been chosen. This signal addresses the selection register associated with that selection and causes the addressed selection register to have its count value increased by one. Similarly, each time a choice is made, the total register is addressed and its count is increased by one. I so design my apparatus that when any of the selection registers or the total register have been increased to the largest count value which they are capable of holding, they cannot be further increased so as in effect to pass through zero.

When the apparatus is in a read mode, it will start sequential display of the count values contained within its selection registers. The apparatus contains and up/-down switch. When the switch is in the up position, the apparatus will first display those selections which have been chosen zero times, then those selections which have been chosen one time, and then those selections which have been chosen two times, etc., until it displays that selection chosen most frequently. If the up/down switch is set to the down position, the apparatus displays first the most frequent selection, and the least frequent selection is displayed last.

BRIEF DESCRIPTION OF THE DRAWINGS

The accompanying drawing which forms part of the instant specification and is to be read in conjunction therewith is a schematic view of one embodiment of my Electronic Vending Machine Selection Counter.

DESCRIPTION OF THE PREFERRED EMBODIMENT

Referring now to the drawing, I have shown schematically one embodiment of my invention in which for purposes of simplicity and for clarity in exposition, I have greatly reduced the number of possible selections, the number of plays which can be stored and displayed for each selection as well as the total number of selections from the numbers actually involved in an actual automatic phonograph.

This embodiment of my invention includes a plurality of selection registers 1, 2, and 3, each capable of storing a value from 0 to 9 in binary coded decimal form, and a total register 4 capable of storing a value from 0 to 99 in binary coded decimal form. When a read/record switch 5 is in the record position, no high voltage is fed by it into OR gate 6, and normally no high voltage will be fed into gate 7. Hence gate 7 will normally be enabled. This allows signals generated by selector switches 8, 9, and 10 to pass through gate 7, and respectively through gates 11, 12, and 13, to selection registers 1, 2, and 3. Each time one of the selector switches 8, 9, or 10 closes, a signal passes to the add input of its associated selection register, causing the count value in that selection register to increase by one. Further, each time any one of the selection switches 8, 9, or 10 is closed, a positive signal passes through an OR gate 14 and through gate 15 to the add input of total register 4. As a result each time a given selection is chosen and its associated selector switch 8, 9, or 10 is closed, its associated selection register is increased, so that its count value will record the total number of times that selection has been chosen, and the total register will be increased so that it will record the total number of all choices made.

Each of a plurality of two-input AND gates 16, 17, and 18 receive an input from the one's place and the eight's place output from its associated selection register. Thus, when the count of a register 1, 2, or 3 reaches the value nine, the corresponding AND gate 16, 17, or 18 applies a signal to the inhibiting input of its associated gate 11, 12, or 13, to prevent further signals from its associated selector switches 8, 9, or 10 from increasing the value of its associated selection register. This prevents the count value of any of the selection registers from being increased beyond a value of 9, which is the highest value the display system can indicate, and prevents the count of the selection register from being cycled through zero. I also provide total register 4 with a four-input AND gate 19, which receives inputs from the one's place and the eight's place outputs from each of the two binary coded decimal digits carried in the register. Thus, when the count in total register 4 reaches ninety-nine, AND gate 19 produces an output which is fed by OR gate 6 to the inhibiting terminal of gate 7 and to the inhibiting terminal of gate 15. Gate 15 then prevents any further stepping of total register 4; and gate 7 then prevents any further stepping of any of the selection registers 1 through 3. Inhibiting the selection registers from recording choices made after the total register has reached its capacity prevents them from losing the information they are intended to record concerning the frequency with which their associated selections have been chosen relative to the total number of choices made. A reset switch 20 may be closed to apply a signal to each of the selection registers and to the total register to reset their count values to 0 so that a new count can be initiated.

When read/record switch 5 is switched from record to read, a signal travels from that switch, through OR gate 6, so as to inhibit gate 7. As a result, the apparatus ceases to respond to the operation of selector switches 8, 9, and 10. Rather, it begins to display the contents of the selection registers. With switch 5 in the record position, a two-input OR gate 30 applies a signal to the inhibiting input terminals of seven segment decoder-drivers 31 and 33. But when switch 5 is moved to the read position decoder-drivers 31 and 33 are no longer inhibited so that associated display devices 32 and 34 can be activated. During the read mode, display devices 32 and 34 will be able to display data fed to their decoder-drivers 31 and 33 so long as an AND gate 35 provides no input to the other input terminal of OR gate 30. When read/record switch 5 is first switched to the read mode, a monostable multivibrator 36 is triggered. Its output pulse passes through a three-input OR gate 37, through the arm 40C of a ganged up/down switch 40 and to count register 41. If up/down switch 40 is in the up position, this initialization pulse from monostable multivibrator 36 will travel through arm 40C and cause count register 41 to be set with an initial count value of zero. If up/down switch 40 is in the down position, this pulse will cause count register 41 to be set with an initial count value of nine. This output pulse from monostable multivibrator 36 also sets the initial count value of a "done" register 42 to zero. The pulse travels through a two-input OR gate 43 to set the initial count of an "address" register 44 to one, and it sets a flip-flop 45 so that its Q output is present.

In the state of the apparatus just described, it is ready to begin its search for selection registers having values which compared with the count values stored in the count register. Address register 44 puts out the binary value of its count, which is initially one. This output is fed into address decoder 50, which decodes the binary output of address register 44 and sends a signal out its output line having a number equal to the number of its binary input. When the read/record switch is in the read position, a gate 51 is turned on. When an output line of address decoder 50 carries an output during the read mode, the output passes through gate 51 and turns on the gate 52, 53, or 54, corresponding to the output number. This causes the binary coded decimal output of selection register 1, 2 or 3, whichever is associated with the given gate 52, 53, or 54, to pass through the gate and to be fed into one of the comparison inputs of a comparator 60. I feed the binary coded decimal output of counter register 41 to the other comparison input of comparator 60. Whenever the value input from selection register 1, 2, or 3 matches that input from count register 41, the "no-comparison" output "N" of comparator 60 will go low. Otherwise it remains high.

In our initial state, address register 44 has been set to an address value of 1, causing address decoder 50 to provide an output which causes gate 52 to feed the output of selection register 1 to comparator 60. This value is compared with the output of count register 41, which is initially a zero if the apparatus is in the up mode or a nine, if it is in the down mode. If the output of selection register 1 does not match the output of count register 41, the no-comparison line of comparator 60 will be high. When the no-comparison output of comparator 60 is high, it provides one input to AND gate 35. As will more fully be explained hereinbelow, my apparatus includes a flip-flop 923, the "Q" output of which is low unless the apparatus is set to display the contents of the total register. The Q output from flip-flop 93 is applied to the other and inverting input to AND gate 35. Thus, AND gate 35 will produce an output which travels through OR gate 30 so as to blank decoder-drivers 31 and 33 only when there is no match at comparator 60 and the apparatus is not set to display the total count.

I also apply the no-comparison output N to a two-input AND gate 61. The other input of AND gate 61 is a 100 pulse per second clock 62. When the no-comparison output line is held high, AND gate 61 will have a high output whenever clock 62 puts out a pulse. This output from AND gate 61 passes through a two-input OR gate 63 to provide one input to a two-input AND gate 64. The other input to AND gate 64 is the Q output from flip-flop 45 which was set high at the initiation of a ready by the output pulse of monostable multivibrator 36. Thus, once the no-comparison line of comparator 60 goes high, the next clock pulse of clock 62 will increase the count of address register 44 from its initial address count of 1 to a second address count of 2. This will cause address decoder 50 to produce a "2" output coupled to gate 53 to cause the output of selection register 2 to be fed into the comparator 60 and to be compared with the output of count register 41. If no comparison occurs between these two values, the no-comparison line will remain high and the next clock pulse output by clock 62 will actuate address register 44 again, so that address decoder 50 will have its "3" output high, which will cause the output from selection register 3 to be compared with the output from count register 41. If no comparison exists between these two values, the non-comparison line will remain high causing the next clock pulse output by clock 62 to actuate address register 44 once more. This time, however, the count in address register 44 will be increased to four. The resultant signal passes through a two-input OR gate to reset address register 44 to 1. At the same time, the output line from the four's place of address register 44 will increase "done" register 42 by one and will cause the count of register 41 to be either raised by one or lowered by 1, depending upon the position of the arm 40*b* of the up/-down switch 40. It will add to the count of register 41 if the up/down switch is in the up position and it will subtract from the count if it is in the down position.

As long as no-comparison takes place between the output of the selection register 1, 2, or 3 being compared with the value currently in the count register 41, the no-comparison line carries an output, the digital display device 32 and 34 are deactivated and the count of address register 44 is increased by each clock pulse of clock 62, so that each selection register will have its output value compared with a given value in the count register until all selection registers have sequentially been compared with that given value. Following the completion of these operations, the next clock pulse will cause the address register's four's place output line to go high, which will reset the address register, step done register 42 up and either add to or subtract from the count of register 41, depending upon the setting of the up/down switch. This process is repeated until either a comparison is found, or until each selection register had been compared against each count value.

Whenever the output of a selection register which is gated to the input of comparator 60 matches the output of count register 41, the no-comparison output N of comparator 60 goes low. When this occurs the output of AND gate 61 stays low even in the presence of pulses from clock 62. The output pulses of clock 62 will not pass through OR gate 63 and AND gate 64 and thus will not add to the count of address register 44. Since clock 62 ceases to step address register 44 up, address decoder 50 continues to gate the output of the same selection register to comparator 60 which was found to have the same output value as count register 41. For this reason, the output of comparator 60 remains constant and the no-comparison line remains low. When the no-comparison output at N is low, neither AND gate 35 nor OR gate 30 has an output, since the read/record switch is in the read position. Under these conditions there is no input to the blanking inputs B of decoder-drivers 31 and 33, and digital display devices 32 and 34 are enabled. A normally enabled gate 70 feeds the binary coded decimal output of count register 41 to digital display device 34. A flip-flop 93 produces an output which disables gate 70 when the count of the total register is to be displayed, in a manner to be described. A normally enabled gate 72 feeds the address currently held in the address register, to drive 31 to display the selection number on digital display device 32. Thus, when a selection register is found to have a value matching the value of the count register, its associated selection number will be displayed on digital display device 32 and the value of count register 41 which matches the value held within the selection register will be displayed on digital display device 34.

This display continues until step switch 74 is closed against the action of a spring 75. When step switch 74 closes a pulse passes through OR gate 63 to one terminal of AND gate 64 the other input to which is provided by flip-flop 45, which is set during the read process. The resultant output from AND gate 64 steps address register 44. Thus, closing step switch 74 causes the next sequential selection register to have its value compared with the value in the count register, or if all selection registers have had their value compared with that currently in the count register, it will cause the first selection register value to be compared with the next sequential count value. If a comparison exists between these two values, the selection number of the selection register and the associated count value will be displayed and will continue to be displayed until step switch 74 is pushed again. If these values do not compare, the no-comparison output N will go high and each selection register will be sequentially compared against the value in the count register for all the remaining value in the count register until either the next match takes place or until each selection register has been compared against all count values.

When the last selection register 3 in the embodiment shown has had its count value compared against the final count value in count register 41, either a nine in an up count or a zero in a down count, the next actuation of address register 44, either by clock 62 or step switch 74, will cause the four's place output of address register 44 to provide an output. This will step "done" register 42 and cause its count to reach ten. When this happens eight's place and two's place outputs of "done" register 42 will cause the output of a two-input AND gate 80 to go high. This output of gate 80 illuminates a light 81, signalling that all selection registers have been compared with all count values and that the search for matching values has been completed. Similarly, it will provide an input to OR gate 82, to reset flip-flop 45. As a result one input will be removed from AND circuit 64 to prevent further stepping of address register 44.

Either after a search has been completed, as will be indicated by light 81, or before it has been completed, step switch 74 can be held down for a long period of time, causing the apparatus to display the contents of the total register. When step switch 74 is held down, it provides one input to a two-input gate 90. Clock pulse generator 62 provides the other input to gate 90 so that the gate produces an output for each pulse from generator 62 while switch 74 is closed. A time register 91 responsive to the output of gate 90 counts the number of clock pulses which have elapsed since that switch 74 was first closed. An inverter 92 responsive to the opening of switch 74 resets register 91 to zero. If step switch 74 is held down for approximately 1.28 seconds, time register 91 will record 128 pulses, producing an output of the 128's place. This output sets flip-flop 93 to produce a Q output which inhibits gates 70 and 72 and enables gates 71 and 73. Under these conditions the low order binary coded decimal output of total register 4 passes through gate 71 to decoder-drivers 33, and the high order binary coded decimal output of total register 4 passes through gate 73 to decoder-drivers 31. As a result, the low order digit of the count stored in total register 4 will be displayed in digital display device 34 and the high order digit of the count held in total register 4 will be displayed in digital display device 32. When the Q output of flip-flop 93 is present, gate 35 is disabled to prevent a blanking input into decoder-drivers 31 and 33.

Holding step switch 74 down for over 1.28 seconds so as to cause a display of the total register during the process of comparing the selection registers against all of the count values will interrupt, but not upset that process of comparison. It will only have the effect of stepping address register 44 by one, because the output of OR gate 63 remains high, thus masking or suppressing clock pulses applied thereto. When step switch 74 is finally allowed to open after it has been held down for a sufficiently long time to cause the display of the total register, the input to inverter gate 92 goes low, causing its output to go high. This will not only reset time register 91, but it will also reset flip-flop 93. As a result, gates 71 and 73 will be turned off and gate 72 and 70 will be turned on again, so that count values and selection numbers can be displayed the next time a match is found to take place between the count of a selection register and the value currently in the count register.

Whenever the up/down switch 40 is changed from its up to its down position, the apparatus is initiated to start a new search for comparisons between the values held in selection registers and the various count values of the count register. This is accomplished by arm 40*a* of up/-down gang switch 40, which triggers a monostable multivibrator 100 whenever the switch is first set to either an up or a down position. The output of monostable multivibrator 100 passes through an OR gate 37 to produce the same effect as a pulse from monostable multivibrator 36. Similarly, when a reset switch 20 is closed, a monostable multivibrator 101 feds a pulse through OR gate 37 to produce the same effect as a pulse from multivibrator 36.

As has been pointed out hereinabove, it will be obvious to one skilled in the art that a practical embodiment of my invention would contain a greater number of selection registers and would have a capacity to hold, sort and display much larger count values than the embodiment shown and described herein. Similarly, it will be obvious to one skilled in the arts that the addressing, setting, count increasing, count decreasing and comparing of register counts, and other logical functions performed in the embodiment shown and described herein could be performed in another embodiment of my invention by a programmable logical device.

It will be seen that I have accomplished the objects of my invention. I have provided apparatus for counting the number of choices of various selections offered by a vending machine. More particularly, I have provided electronic means for registering the popularity of various selections in a jukebox. My apparatus automatically displays the number of times each selection has been played in either ascending or descending order, as well as the number of total plays. My selection counter has digital accuracy.

It will be understood that certain features and subcombinations are of utility and may be employed without reference to other features and subcombinations. This is contemplated by and is within the scope of my claims. It is further obvious that various changes may be made in details within the scope of my claims without departing from the spirit of my invention. It is, therefore, to be understood that my invention is not to be limited to the specific details shown and described.

Having thus described my invention, what I claim is:

1. Apparatus including in combination manually actuable selection means for effecting a plurality of merchandising selections one at a time, a plurality of counting registers corresponding to said selections, each of said counting registers being adapted to store a count and having an identifying signal associated therewith, individual indexing means responsive to said selection means for incrementing the count of the register corresponding to the effected selection, means for interrogating said counting registers, and means responsive to said interrogating means for successively generating said identifying signals in such an order that the counts of the registers successively identified form a monotonic sequence.

2. Apparatus as in claim 1 in which said generating means is selectively operable to generate said signals in a sequence of nonincreasing or nondecreasing register.

3. Apparatus including in combination manually actuable selection means for effecting a plurality of merchandising selections one at a time, a plurality of counting registers corresponding to said selections, each of said counting registers being adapted to store a count and having an identifying symbol associated therewith, individual indexing means responsive to said selection means for incrementing the count of the register corresponding to the effected selection, means for interrogating said counting registers, and means responsive to said interrogating means for successively displaying said identifying symbols in such an order that the counts of the registers successively identified form a monotonic sequence.

4. Apparatus as in claim 3 further including means for displaying the count of each register concurrently with the display of the symbol associated therewith.

5. Apparatus as in claim 4 in which each of said counting registers includes means responsive to a predetermined count of said register for inhibiting the further incrementing of said register count by said individual indexing means.

6. Apparatus as in claim 5 in which said displaying means is capable of displaying a certain maximum register count, said predetermined count corresponding to said maximum register count.

7. Apparatus as in claim 3, further including a total register and total indexing means responsive to actuation of said selection means to effect any one of said selections for incrementing the count of said total register, said total indexing means incrementing said total register count equally in response to actuation of said selections means to effect any one of said selections.

8. Apparatus as in claim 7, further including means responsive to a predetermined count of said total register for inhibiting the further incrementing of any of said register counts by said individual indexing means.

9. Apparatus as in claim 7, further including means for coupling said total register to said displaying means.

10. Apparatus as in claim 3, further including manually controllable means for interrupting the operation of said interrogating means.

11. Apparatus including in combination manually actuable selection means for effecting a plurality of merchandising selections one at a time, a plurality of counting registers corresponding to said selections, each of said counting registers being adapted to store a count and having an identifying symbol associated therewith, means responsive to said selection means for incrementing the count of the register corresponding to the effected selection, a comparison register adapted to store a count, means for successively incrementing the count of said comparison register, means responsive to said incrementing means for sequentially interrogating said counting registers, for each count of said comparison register, and means responsive to the interrogation of a counting register having a count equal to that of the comparison register for displaying the symbol associated with said counting register.

12. Apparatus including in combination single coin-enabled selection means manually actuable for effecting a plurality of entertainment selections one at a time, a plurality of counting registers corresponding to said selections, each of said counting registers being adapted to store a count and having an identifying symbol associated therewith, individual indexing means responsive to said selection means for incrementing the count of the register corresponding to the effected selection, selectively operable means for successively displaying the identifying symbols associated with said counting registers, and means responsive to said counting registers for displaying concurrently with the display of each of said identifying symbols a symbol derived from the count of the corresponding register.

13. Apparatus as in claim 12, further including manually controllable means for interrupting the operation of each of said displaying means.

14. Apparatus including in combination single coin-enabled selection means manually actuable for effecting a plurality of entertainment selections one at a time, a plurality of counting registers corresponding to said selections, each of said counting registers being adapted to store a count and havng an identifying symbol associated therewith, individual indexing means responsive to said selection means for incrementing the count of the register corresponding to the effected selection, selectivity operable means for successively displaying the identifying symbols associated with said counting registers, and means responsive to said counting registers for displaying concurrently with the display of each of said identifying symbols the count of the corresponding register.

15. Apparatus as in claim 14 in which said identifying symbols are displayed in such an order that the counts of the registers successively identified form a monotonic sequence.

16. Apparatus as in claim 14 in which each of said counting registers includes means responsive to a predetermined count of said register for inhibiting the further incrementing of said register count by said individual indexing means.

17. Apparatus as in claim 16 in which said displaying means is capable of displaying a certain maximum register count, said predetermined count corresponding to said maximum register count.

18. Apparatus as in claim 14, further including a total register and total indexing means responsive to actuation of said selection means to effect any one of said selections for incrementing said total register count, said total indexing means incrementing said register count equally in response to actuation of said selection means to effect any one of said sections.

19. Apparatus as in claim 18, further including means for coupling said total register to said displaying means.

20. Apparatus including in combination means for effecting a plurality of selections one at a time, a plurality of counting registers corresponding respectively to aid selections, individual indexing means responsive to the selection means for incrementing the count of the register corresponding to the effected selection, a total register, total indexing means responsive to actuation of said selection means to effect any one of said selections for incrementing the count of said total register, and means responsive to a predetermined count of said total register for inhibiting the further incrementing of any of said register counts by said individual indexing means.

21. Apparatus including in combination single selection means manually actuable for effecting a plurality of merchandising selections one at a time, each of said selections being capable of being effected repeatedly, a plurality of counting registers corresponding respectively to said selections, individual indexing means responsive to the selection means for incrementing the count of the register corresponding to the effected selection, said individual indexing means being identically responsive to successive identical actuations of said selection means, each of said register being capable of having its own count incremented repeatedly, means for displaying said register counts, means for coupling each of said register counts to said displaying means in an automatically generated sequence, a total register, total indexing means responsive to actuation of said selection means to effect any one of said selections for incrementing said register count, said total indexing means incrementing said register count equally in response to actuation of said selection means to effect any one of said selections, and means responsive to a predetermined count of said total register for inhibiting the further incrementing of any of said register counts by said individual indexing means.

* * * * *

UNITED STATES PATENT AND TRADEMARK OFFICE

CERTIFICATE OF CORRECTION

PATENT NO. : 4,223,210

DATED : September 16, 1980

INVENTOR(S) : Lee C. Verduin

It is certified that error appears in the above-identified patent and that said Letters Patent are hereby corrected as shown below:

Column 8, line 3, after "register" insert -- counts --;

Column 10, line 10, "aid" should read -- said --;

line 36, after "said" insert -- total --.

Signed and Sealed this

*Twenty-fifth* Day of *November 1980*

[SEAL]

*Attest:*

SIDNEY A. DIAMOND

*Attesting Officer*

*Commissioner of Patents and Trademark*